US008852366B2

(12) United States Patent
Kondo et al.

(10) Patent No.: US 8,852,366 B2
(45) Date of Patent: Oct. 7, 2014

(54) METHOD FOR PRODUCING STEEL PIPE WITH EXCELLENT EXPANDABILITY

(75) Inventors: Kunio Kondo, Hyogo (JP); Yuji Arai, Hyogo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/017,087

(22) Filed: Jan. 31, 2011

(65) Prior Publication Data

US 2011/0186188 A1 Aug. 4, 2011

Related U.S. Application Data

(60) Division of application No. 12/575,028, filed on Oct. 7, 2009, now abandoned, which is a continuation of application No. PCT/JP2008/066624, filed on Sep. 16, 2008.

(30) Foreign Application Priority Data

Oct. 30, 2007 (JP) ..... 2007-281613

(51) Int. Cl.

| | |
|---|---|
| ***C21D 9/08*** | (2006.01) |
| ***C22C 38/04*** | (2006.01) |
| ***C21D 1/56*** | (2006.01) |
| ***C22C 38/02*** | (2006.01) |
| ***C21D 11/00*** | (2006.01) |
| ***C22C 38/06*** | (2006.01) |
| *C21D 8/10* | (2006.01) |

(52) U.S. Cl.

CPC ..... *C22C 38/02* (2013.01); *C22C 38/04* (2013.01); *C21D 8/10* (2013.01); *C21D 2211/009* (2013.01); *C21D 2211/002* (2013.01); *C21D 1/56* (2013.01); *C21D 2211/008* (2013.01); *C21D 2211/005* (2013.01); *C21D 11/005* (2013.01); *C22C 38/06* (2013.01); *C21D 9/08* (2013.01)

USPC ..... 148/590; 148/500

(58) Field of Classification Search

CPC ..... C21D 11/005; C21D 1/56; C21D 9/08; C21D 6/00

USPC ..... 148/500, 590

See application file for complete search history.

(56) References Cited

U.S. PATENT DOCUMENTS

| | | | |
|---|---|---|---|
| 5,470,529 | A | 11/1995 | Nomura et al. |
| 6,290,789 | B1 | 9/2001 | Toyooka et al. |

FOREIGN PATENT DOCUMENTS

| | | |
|---|---|---|
| JP | 2002-129283 | 5/2002 |
| JP | 2005-146414 | 6/2005 |
| JP | 2006-009078 | 1/2006 |

OTHER PUBLICATIONS

Machine translation of JP 2006-009078, Yamazaki Yoshio et al, Dec. 2006.*

*Primary Examiner* — Jie Yang

(74) *Attorney, Agent, or Firm* — Clark & Brody

(57) ABSTRACT

A steel pipe with excellent expandability, comprising, by mass %, C: 0.1 to 0.45%, Si: 0.3 to 3.5%, Mn: 0.5 to 5%, P: less than or equal to 0.03%, S: less than or equal to 0.01%, soluble Al: 0.01 to 0.8% (more than or equal to 0.1% in case Si content is less than 1.5%), N: less than or equal to 0.05%, O: less than or equal to 0.01%, and balance being Fe and impurities, having a mixed microstructure comprising ferrite and one or more selected from fine pearlite, bainite and martensite, and having a tensile strength of more than or equal to 600 MPa and a uniform elongation satisfying following formula (1).

This steel pipe, having the above described chemical composition, can be obtained, for example, by being heated at temperatures from 700 to 790° C., then being forced-cooled down to a temperature of lower than or equal to 100° C. with the cooling rate of greater than or equal to 100° C./min at the temperature from 700 to 500° C.

$$u\text{-}el \geq 28 - 0.0075TS \quad (1),$$

wherein u-el means uniform elongation (%), and TS means tensile strength (MPa).

1 Claim, 1 Drawing Sheet

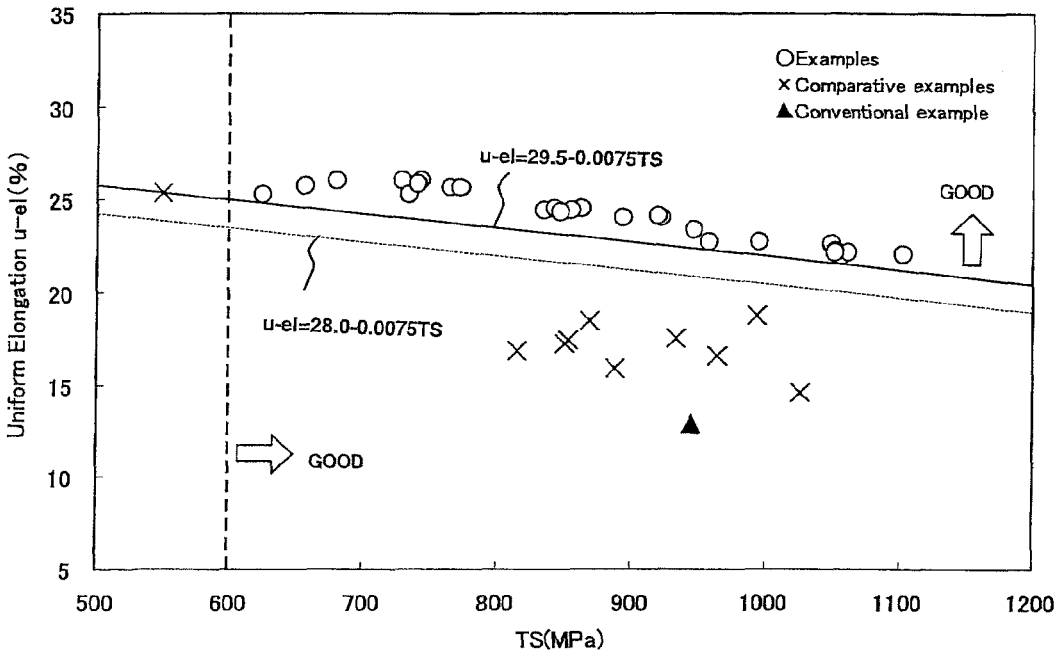
35
30
25
20
15
10
5
Uniform Elongation u-el(%)
500
600
700
800
900
1000
1100
1200
TS(MPa)
OExamples
× Comparative examples
▲Conventional example
u-el=29.5-0.0075TS
u-el=28.0-0.0075TS
GOOD
GOOD

METHOD FOR PRODUCING STEEL PIPE WITH EXCELLENT EXPANDABILITY

The disclosure of International Application No. PCT/JP2008/066624 filed Sep. 16, 2008 including specification, drawings and claims is incorporated herein by reference in its entirety.

TECHNICAL FIELD

The present invention relates to, for example, a steel pipe which is used for drilling an oil well or a gas well, and is expanded in the well, and a method for producing the same.

BACKGROUND ART

In a well for piping up oil or gas from an oilfield or gas field, the casing to prevent a collapse of a side wall during/after drilling usually has a nested structure, and multiple casings are nested in the portion near the land surface. In case of the nested casings structure, a big bore corresponding to the outer casing have to be drilled, which leads to high cost. In recent years, in order to solve the problem described above, expandable casing technology, that is expanding the casing in the well. According to this technique, it becomes possible to complete the well by drilling smaller diameter well, compared to the conventional method, leading to the possibility in marked cost down.

However, in case of well construction using one well with uniform diameter from the top to the bottom portion, a considerable large ratio of the pipe expansion is needed, leading to problems such as large bending or perforated portion due to local thinning of the pipe. This has been a hurdle for the practical application of this method. As to the steel pipe with a high expanding performance, the following patents have been disclosed.

Patent Document 1 discloses a seamless steel pipe for an oil well with excellent expandability, which is characterized by a given chemical composition in order to keep the residual austenite phase of more than or equal to 5% volume fraction.

Patent Document 2 discloses a seamless steel pipe for an oil well, which is characterized by a given chemical composition and also by the relationship among the contents of Mn, Cr and Mo and the relationship the contents among C, Si, Mn, Cr and Mo.

[Patent Document 1] JP 2006-9078 A

[Patent Document 2] JP 2005-146414 A

DISCLOSURE OF THE INVENTION

Problems to be Solved by the Invention

Both of the Patent Documents 1 and 2 disclose technologies of steel pipes considering pipe expandability. However, the examples of the patents disclose materials with at most 21% of uniform elongation at a tensile strength level of 700 to 800 MPa, but did not show enough performance of the pipe expansion.

Thus, the present inventors have investigated a creation of materials with large uniform elongation, on the basis of knowledge that it is important to increase uniform elongation of the materials in order to achieve a much improved expandability. As the results, the uniform elongation of tempered martensite steel, which has mainly been used for a seamless steel pipe for an oil well, has been found to be poor in general. Further study by the present inventors and coworkers revealed that the poor uniform elongation originates from tempered martensite structure consisting of ferritic single phase. So the present inventors investigated the effects of the metallographic structure of the uniform elongation, and obtained following information.

(a) An uniform martensite structure is obtained by quenching, which has been a predominate method of the heat treatment for producing the seamless steel pipe for an oil well, and then the structure changes into ferritic single phase by the subsequent tempering. In this way, this method has a inadequacy, from a view point of uniform elongation.

(b) When a seamless pipe for an oil well was air cooled after heating at the quenching temperature, the observed microstructure consisted of a ferrite/pearlite mixed structure, and the uniform elongation was much improved in a comparison at the same strength level. This result shows that uniform elongation is better in a case of the mixed structure of softer ferrite and harder pearlite than in case of a single phase microstructure.

(c) However, it is difficult to find enough strength and toughness, which are required for an oil well pipe in the case of the mixed structure of ferrite and pearlite.

The objective of present invention is to provide a steel pipe, having tensile strength of higher than or equal to 600 MPa and an excellent expandability, so that any large bending or perforated portion due to local thinning of the pipe cannot be formed even when the pipe is expanded at high expanding ratio. Also, another objective of the present invention is to provide a method for producing such steel pipes.

Means for Solving the Problems

[1] A steel pipe with excellent expandability, which has a steel composition comprising, by mass %, C: 0.1 to 0.45%, Si: 0.3 to 3.5%, Mn: 0.5 to 5%, P: less than or equal to 0.03%, S: less than or equal to 0.01%, soluble Al: 0.01 to 0.8% (more than or equal to 0.1% in case Si content is less than 1.5%), N: less than or equal to 0.05%, 0: less than or equal to 0.01%, and optionally at least one element selected from at least one of Groups (A) to (E) specified below, and balance being Fe and impurities, wherein the steel has a mixed microstructure comprising ferrite and one or more selected from fine pearlite, bainite and martensite, and has a tensile strength of 600 MPa or more and a uniform elongation satisfying the following formula (1).

$$\text{u-el} \geq 28 - 0.0075\text{TS} \quad (1),$$

wherein u-el means uniform elongation (%), and TS means tensile strength (MPa):

wherein Group (A) of elements is; Cr: less than or equal to 1.5% and Cu: less than or equal to 3.0%;

wherein Group (B) of elements is; Mo: less than or equal to 1%;

wherein Group (C) of elements is; Ni: less than or equal to 2%;

wherein Group (D) of elements is; Ti: less than or equal to 0.3%, Nb: less than or equal to 0.3%, V: less than or equal to 0.3%, Zr: less than or equal to 0.3%, and B: less than or equal to 0.01%;

wherein Group (E) of elements is: Ca: less than or equal to 0.01%, Mg: less than or equal to 0.01%, and REM: less than or equal to 1.0%.

[2] The steel pipe with excellent expandability described in the above [1], wherein the steel pipe has a uniform elongation satisfying the following formula (2).

$$\text{u-el} \geq 29.5 - 0.0075\text{TS} \quad (2),$$

wherein u-el means uniform elongation (%), and TS means tensile strength (MPa).

[3] The steel pipe with excellent expandability described in the above [1], wherein the mixed microstructure further comprises residual austenite.

[4] The steel pipe with excellent expandability described in the above [2], wherein the mixed microstructure further comprises residual austenite.

[5] A method for producing a steel pipe with excellent expandability, comprising the steps of:

(a) heating the steel pipe which has a steel composition comprising, by mass %, C: 0.1 to 0.45%, Si: 0.3 to 3.5%, Mn: 0.5 to 5%, P: less than or equal to 0.03%, S: less than or equal to 0.01%, soluble Al: 0.01 to 0.8% (more than or equal to 0.1% in case Si content is less than 1.5%), N: less than or equal to 0.05%, 0: less than or equal to 0.01%, and optionally at least one element selected from at least one of Groups (A) to (E) specified below, and balance being Fe and impurities, wherein Group (A) of elements is; Cr: less than or equal to 1.5% and Cu: less than or equal to 3.0%;

wherein Group (B) of elements is; Mo: less than or equal to 1%;

wherein Group (C) of elements is; Ni: less than or equal to 2%;

wherein Group (D) of elements is Ti: less than or equal to 0.3%, Nb: less than or equal to 0.3%, V: less than or equal to 0.3%, Zr: less than or equal to 0.3%, and B: less than or equal to 0.01%;

wherein Group (E) of elements is: Ca: less than or equal to 0.01%, Mg: less than or equal to 0.01%, and REM: less than or equal to 1.0%, to a temperature from 700 to 790° C., and (b) forced-cooling the steel pipe down to a temperature lower than or equal to 100° C., wherein the steel pipe is forced-cooled with a cooling rate greater than or equal to 100° C./min at a temperature ranging from 700 to 500° C.

[6] A method for producing a steel pipe with excellent expandability, comprising steps of:

(a) heating the steel pipe which has a steel composition comprising, by mass %, C: 0.1 to 0.45%, Si: 0.3 to 3.5%, Mn: 0.5 to 5%, P: less than or equal to 0.03%, S: less than or equal to 0.01%, soluble Al: 0.01 to 0.8% (more than or equal to 0.1% in case Si content is less than 1.5%), N: less than or equal to 0.05%, 0: less than or equal to 0.01%, and optionally at least one element selected from at least one of Groups (A) to (E) specified below, and balance being Fe and impurities, wherein Group (A) of elements is; Cr: less than or equal to 1.5% and Cu: less than or equal to 3.0%;

wherein Group (B) of elements is; Mo: less than or equal to 1%;

wherein Group (C) of elements is; Ni: less than or equal to 2%;

wherein Group (D) of elements is; Ti: less than or equal to 0.3%, Nb: less than or equal to 0.3%, V: less than or equal to 0.3%, Zr: less than or equal to 0.3%, and B: less than or equal to 0.01%;

wherein Group (E) of elements is: Ca: less than or equal to 0.01%, Mg: less than or equal to 0.01%, and REM: less than or equal to 1.0%, to a temperature from 700 to 790° C., (b) forced-cooling the steel pipe down to a temperature from 250 to 450° C., wherein the steel pipe is forced-cooled with a cooling rate greater than or equal to 100° C./min at a temperature ranging from 700 to 500° C., (c) soaking the steel pipe at a temperature from 250 to 450° C. for 10 min. or more, and then (d) cooling the steel pipe down to room temperature.

[7] A method for producing a steel pipe with excellent expandability, comprising steps of (a) heating the steel pipe which has a steel composition comprising, by mass %, C: 0.1 to 0.45%, Si: 0.3 to 3.5%, Mn: 0.5 to 5%, P: less than or equal to 0.03%, S: less than or equal to 0.01%, soluble Al: 0.01 to 0.8% (more than or equal to 0.1% in case Si content is less than 1.5%), N: less than or equal to 0.05%, 0: less than or equal to 0.01%, and optionally at least one element selected from at least one of Groups (A) to (E) specified below, and balance being Fe and impurities, wherein Group (A) of elements is; Cr: less than or equal to 1.5% and Cu: less than or equal to 3.0%;

wherein Group (B) of elements is; Mo: less than or equal to 1%;

wherein Group (C) of elements is Ni: less than or equal to 2%;

wherein Group (D) of elements is Ti: less than or equal to 0.3%, Nb: less than or equal to 0.3%, V: less than or equal to 0.3%, Zr: less than or equal to 0.3%, and B: less than or equal to 0.01%;

wherein Group (E) of elements is: Ca: less than or equal to 0.01%, Mg: less than or equal to 0.01%, and REM: less than or equal to 1.0%, to a temperature from 700 to 790° C., (b) forced-cooling the steel pipe down to a temperature from above 250 to 450° C., wherein the steel pipe is forced-cooled with a cooling rate greater than or equal to 100° C./min at a temperature ranging from 700 to 500° C., (c) control-cooling the steel pipe from the finish temperature of the forced-cooling to 250° C. at a cooling rate lower than or equal to 10° C./min, and then (d) cooling the steel pipe down to room temperature.

Effect of the Invention

In the pipe expansion process even at a large expansion ratio by using a steel pipe in the present invention, there are no problems such as large bending or perforated portion due to local thinning of the pipe.

BRIEF DESCRIPTION OF THE DRAWINGS

FIG. 1 A view showing relationship between tensile strength and uniform elongation for the present invention and comparative methods.

BEST MODE FOR CARRYING OUT THE INVENTION

The steel pipe in the present invention has a superior pipe expandability, in spite of high tensile strength of more than or equal to 600 MPa. Also, the method for producing a steel pipe in the present invention discloses the method comprising making a steel pipe with a given chemical composition and heat treating in a given condition in order to improve expandability of the steel pipe. First, the chemical composition of the present invention will be described below, and then the heat treatment condition and the reasons for restrictions will be described.

1. Chemical Composition

C: 0.1 to 0.45%

Carbon is an essential element to determine the material strength. That is, C has a role of improving uniform elongation by increasing the difference of strength between softer and harder phases. To achieve this effect a C content of more than or equal to 0.1% is needed. On the contrary, the content exceeding 0.45% deteriorates the toughness, because of excessive hardening of the harder phase. Therefore, the C content is regulated to 0.1 to 0.45%. A favorable lower limit is 0.15%, more favorably 0.25%, and further desirably 0.35%.

Si: 0.3 to 3.5%

Silicon is an important element in order to achieve the large uniform elongation because Si contributes to stabilize a softer phase and it certainly obtains the softer phase. In order to achieve this effect, a content of 0.3% or more is needed. On the contrary, the excess addition of Si deteriorates hot workability, therefore, the Si content should be regulated to 0.3 to 3.5%. In order to ensure a sufficiently large uniform elongation, the favorable lower limit of Si should be 1.5% but a more favorably lower limit is 2.1%. In case the content of soluble Al is less than 0.1%, the Si content should be 1.5% or more.

Mn: 0.5 to 5%

Manganese is also an important element to keep a large uniform elongation by stabilizing the softer phase, in addition to having a strengthening effect through enhanced quench hardening. In order to achieve these effects, a content of 0.5% or more is needed. On the contrary, an excess addition over 5% introduces toughness deterioration, therefore the content of Mn was regulated to be 0.5 to 5%. A favorable lower limit is 1.0%, and a more favorable lower limit is 2.5%. And a further favorable lower limit is 3.5%.

P: Less than or Equal to 0.03%

Phosphorus deteriorates toughness through a decrease in intergranular adhesion, and the content should be decreased as low as possible. However, excessive lowering of the P content introduces an increase in cost in the steel making process, therefore, from both aspects of keeping toughness and cost concern, the upper limit was regulated to be 0.03%. The admissible upper limit was determined to be 0.04%. In view of maintaining enough toughness the favorable upper limit is 0.02%, and more favorable upper limit should be 0.015%.

S: Less than or Equal to 0.01%

Sulfur deteriorates toughness through a decrease in intergranular adhesion, and favorably the content should be decreased as low as possible. However, excessive lowering of the S content introduces cost up in the steel making process. Therefore, from both aspects of keeping toughness and business concern, the admissible upper limit was regulated to be 0.01%. In view of keeping enough toughness, the favorable upper limit is 0.005%, more favorably the upper limit should be 0.002%.

Soluble Al: 0.01 to 0.8% (More than or Equal to 0.1% in Case Si Content is Less than 1.5%)

Aluminum is necessary for deoxidization, and also has a role to improve the uniform elongation through stabilizing the softer phase. The stabilization effect and good uniform elongation are obtained when the content of soluble Al is 0.01% or more. When the content is too small, it becomes difficult to obtain enough improvement effects. If the content is 0.1% or more, enough improvement effects are achieved. Even when the soluble Al content is 0.01% or more and less than 0.1%, enough improvement effects are obtained, if the Si of 1.5% or more is added. When the content of soluble Al exceeds 0.8%, non-metallic inclusion clusters are formed in the steel making process, leading to toughness deterioration. Therefore, the soluble Al content was regulated to be 0.01 to 0.8%. In case of less than 1.5% Si content, the soluble Al content should be 0.1% or more. In view of keeping uniform elongation, the favorable lower limit of soluble Al is 0.2%, and more favorable lower limit is 0.3%.

N: Lower than or Equal to 0.05%

The upper limit of N as impurities was determined to be 0.05%, because N deteriorates the toughness.

O: Lower than or Equal to 0.01%

The upper limit of O as impurities was determined to be 0.01%, because O deteriorates the toughness.

A steel pipe in the present invention comprises above-described alloying elements, and balance of Fe and impurities. A steel pipe in the present invention may, instead of a part of Fe, contain following elements, in order to improve various properties.

Cr: Lower than or Equal to 1.5%

Chromium is not an essential element, but its addition can strengthen the steel pipe by stabilizing the harder phase through interaction with C atoms, in addition to the enhancing effect for quenching hardening. Thus Cr may be used for the purpose of strengthening. A marked effect is obtained when the content is 0.1% or more, however an excess addition introduces toughness deterioration. Therefore, when Cr is used, the content should favorably be less than or equal to 1.5%.

Cu: Lower than or Equal to 3.0%

Copper is not an essential element, but its addition can strengthen the steel pipe by precipitation hardening during slow cooling or isothermal holding. The marked strengthening effect is obtained when the content is 0.3% or more. However an excessive addition introduces a deterioration in toughness and hot workability. Therefore, when Cu is used, the content should favorably be less than or equal to 3.0%. In order to keep good hot workability, a combined addition with Ni is desirable.

Mo: Lower than or Equal to 1%

Molybdenum is not an essential element, but its addition can improve the corrosion resistance in oilfield circumstances. Therefore, when higher corrosion resistance is needed in a steel pipe, Mo addition is useful. A marked effect is obtained when the content is 0.05% or more. However excess addition introduces deterioration in toughness, therefore, when Cr is used, the content should favorably be less than or equal to 1%.

Ni: Lower than or Equal to 2%

Nickel is not an essential element, but its addition can contribute to keeping large uniform elongation through stabilizing softer phase. A marked effect for softer phase stabilizing is obtained when the content is 0.1% or more. However there is an excessive cost increase, therefore, when Ni is used, the content should favorably be less than or equal to 1.5%, and more favorably the upper limit is 1.0%.

One or More Elements Selected from Ti≤0.3%, Nb≤0.3%, V≤0.3%, Zr≤0.3% and B≤0.01%

Titanium, Niobium, Vanadium and Zircon are not essential elements. In addition of one or more selected from these elements, the grain structure of a steel pipe is refined by their precipitation of carbo-nitrides, leading to toughness improvement. Such effects are marked, when the amount of the one or more elements is 0.003% or more, on the contrary, excessive addition leads to toughness deterioration. Therefore, in case of using one or more elements selected from Ti, Nb, V and Zr, the content of each element should favorably be less than or equal to 0.3%.

Boron is not an essential element, but its addition can improve the toughness of the steel pipe through increasing the intergranular cohesion. Such effects are marked, when the content is more than or equal to 0.0005%. On the contrary, excessive addition introduces carbo-boride formation on the grain boundaries, leading to toughness deterioration. Therefore, when B is added, the content should favorably be less than or equal to 0.01%.

One or More Elements Selected from Ca≤0.01%, Mg≤0.01% and REM≤1.0%

Calcium, Magnesium and REM (rare earth metal) are not essential elements, but the addition of these elements can improve the hot workability, and can be effective in case the steel pipe is produced by severe hot working. The improvement effect for hot workability is marked, when the content of each element is more than or equal to 0.0005%. On the contrary, excessive addition decreases surface precision in the threaded portion. Therefore, using one or more elements selected from Ca, Mg and REM, the content of each element should favorably be less than or equal to 0.01%, 0.01% and 1.0%, respectively. Complex addition of two or more of these elements can lead to a further improvement for hot workability.

Wherein, REM is a collective term showing 17 kind of elements, i.e., Sc, Y and lanthanoid elements, and the content of REM means a total of above-described elements.

2. Method for Manufacturing (1) Steel Making and Pipe Manufacture

Methods of steel making and the pipe manufacturing in the present invention are not limited, and the usual methods can be applied. For example the pipe manufacturing methods, include manufacturing of a seamless steel pipe, seaming by welding after shaping into a cylinder from steel sheets, or the like can be adopted.

(2) Heat Treatment

The present invention can provide a steel pipe with excellent expandability, in which the pipe expansion can be accomplished with a large expansion ratio, by undergoing a given heat treatment to the steel pipe with above-described chemical composition in order to give large uniform elongation. The process of the heat treatment is as follows.

Heating Temperature: 700 to 790° C.

Since the heating temperature is too low, a good quenching hardening effect cannot be obtained, therefore the material should be heated at temperatures higher than or equal to 700° C. On the contrary, since a higher heating temperature decreases or diminishes the ferrite phase in a softer phase, the upper limit should be less than or equal to 790° C. The holding time, which is not limited in the present invention, should favorably be more than or equal to min and less than or equal to 60 min.

Cooling Rate: Average Cooling Rate Higher than or Equal to 100° C./Min in the Temperature Range from 700 to 500° C.

Due to forced-cooling the heated steel pipe down to temperature of lower than or equal to 100° C. by a cooling facility whose cooling ability estimated by the cooling rate from 700 to 500° C. is greater than or equal to 100° C./min, the microstructure of the steel pipe changes into mixed ones, in which the harder pearlite, bainite or martensite disperses finely within the softer ferrite matrix. This results in a largely improved uniform elongation in terms of the mixed microstructure with softer and harder phases.

In a case that a steel pipe is continuously forced-cooled with a usual forced-cooling system, the cooling rate is decreased with lowering temperature unless the means for cooling is changed. In the present invention, forced-cooling down to about 100° C. with a cooling condition in which the average cooling rate at the temperature range from 700 to 500° C. is 100° C./min or more suffices to achieve the objective. A cooling rate lower than 100° C./min is admissible at the temperature range below 500° C.

In addition, soaking subsequent to stopping forced-cooling at a temperature from 450 to 250° C. promotes formation of residual austenite and introduces a marked work hardening effect, resulting in a much improved uniform elongation. In order to obtain enough of this effect, the favorable holding time should be more than or equal to 10 min. After the soaking, any cooling pattern, forced-cooling or air cooling, can be adopted. A similar effect can be obtained by a slow cooling at a cooling rate of 10° C./min or less at the temperature range from the finish temperature of the forced-cooling to 250° C., instead of the soaking, subsequent to stopping forced-cooling at a temperature of above 250° C. but not higher than 450° C., which heat process also promotes formation of residual austenite. After the slow cooling, any cooling pattern, forced-cooling or air cooling, can be adopted.

Others:

Tempering, which is not necessary in the present invention, may be conducted at lower temperatures, at or below 500° C.

EXAMPLES

Steels having chemical compositions shown in Table 1 were melted, hot forged and hot rolled into plate specimens of 10 mm in thickness, 120 mm in width and 330 mm in length. After heat treatments, shown in Table 2, tensile specimens with a gauge diameter of 4 mm were prepared, and tensile strength and uniform elongation were measured by tensile testing.

TABLE 1

| | Chemical composition (mass-%) | | | | | | | | | | |
|---|---|---|---|---|---|---|---|---|---|---|---|
| Steel | C | Si | Mn | P | S | slo.Al | N | O | Cr | Mo | Ni |
| A | 0.33 | 2.78 | 0.77 | 0.016 | 0.0002 | 0.194 | 0.0072 | 0.0009 | — | — | — |
| B | 0.15 | 1.91 | 0.60 | 0.011 | 0.0006 | 0.340 | 0.0051 | 0.0004 | — | — | — |
| C | 0.24 | 1.57 | 1.77 | 0.017 | 0.0014 | 0.335 | 0.0073 | 0.0011 | — | — | — |
| D | 0.21 | 1.67 | 2.01 | 0.008 | 0.0006 | 0.283 | 0.0058 | 0.0011 | 0.35 | — | — |
| E | 0.20 | 3.13 | 0.98 | 0.016 | 0.0007 | 0.345 | 0.0063 | 0.0016 | — | — | 0.51 |
| F | 0.35 | 2.20 | 2.30 | 0.015 | 0.0023 | 0.469 | 0.0080 | 0.0013 | — | — | 0.33 |
| G | 0.32 | 2.99 | 1.06 | 0.011 | 0.0015 | 0.248 | 0.0082 | 0.0015 | 0.23 | — | — |
| H | 0.23 | 3.25 | 1.87 | 0.006 | 0.0022 | 0.365 | 0.0050 | 0.0005 | 0.21 | — | — |
| I | 0.18 | 2.75 | 2.14 | 0.016 | 0.0003 | 0.443 | 0.0083 | 0.0011 | — | — | — |
| J | 0.23 | 2.12 | 2.30 | 0.006 | 0.0024 | 0.474 | 0.0068 | 0.0020 | — | — | — |
| K | 0.34 | 1.55 | 1.16 | 0.013 | 0.0006 | 0.348 | 0.0086 | 0.0019 | — | — | — |
| L | 0.23 | 1.92 | 1.21 | 0.018 | 0.0007 | 0.169 | 0.0062 | 0.0006 | — | — | — |
| M | 0.19 | 1.62 | 2.30 | 0.015 | 0.0012 | 0.338 | 0.0082 | 0.0016 | — | — | — |
| N | 0.26 | 3.06 | 0.83 | 0.021 | 0.0011 | 0.344 | 0.0045 | 0.0011 | — | — | — |
| O | 0.17 | 2.94 | 2.40 | 0.016 | 0.0020 | 0.217 | 0.0088 | 0.0010 | 0.15 | 0.13 | — |
| P | 0.24 | 1.61 | 0.62 | 0.015 | 0.0007 | 0.297 | 0.0082 | 0.0011 | — | — | — |

TABLE 1-continued

| | | | | | | | | | | | |
|---|---|---|---|---|---|---|---|---|---|---|---|
| Q | 0.33 | 2.08 | 0.51 | 0.014 | 0.0007 | 0.289 | 0.0073 | 0.0010 | — | — | — |
| R | 0.16 | 2.74 | 1.72 | 0.011 | 0.0008 | 0.311 | 0.0077 | 0.0016 | — | — | — |
| S | 0.30 | 2.01 | 2.25 | 0.022 | 0.0025 | 0.463 | 0.0048 | 0.0019 | — | — | — |
| T | 0.23 | 2.75 | 1.72 | 0.011 | 0.0012 | 0.492 | 0.0094 | 0.0014 | — | — | — |
| U | 0.34 | 1.59 | 0.66 | 0.008 | 0.0013 | 0.355 | 0.0086 | 0.0002 | — | — | — |
| V | 0.31 | 2.88 | 1.20 | 0.012 | 0.0009 | 0.026 | 0.0042 | 0.0013 | — | — | — |
| W | 0.05* | 2.53 | 1.37 | 0.007 | 0.0024 | 0.331 | 0.0075 | 0.0006 | — | — | — |
| X | 0.25 | 0.20* | 1.52 | 0.016 | 0.0007 | 0.387 | 0.0050 | 0.0005 | — | — | — |
| Y | 0.21 | 0.55 | 0.41* | 0.012 | 0.0014 | 0.471 | 0.0056 | 0.0015 | — | — | — |
| Z | 0.27 | 0.49 | 1.01 | 0.014 | 0.0011 | 0.045* | 0.0068 | 0.0010 | — | — | — |

| | Chemical composition (mass-%) | | | | | | | | |
|---|---|---|---|---|---|---|---|---|---|
| Steel | Ti | Nb | V | Zr | Cu | B | Ca | Mg | REM |
| A | — | 0.025 | — | — | — | — | — | — | — |
| B | — | — | 0.04 | — | — | — | 0.0015 | — | — |
| C | — | — | — | — | 0.62 | — | 0.0010 | — | — |
| D | — | — | — | — | — | — | — | — | — |
| E | — | — | — | — | — | — | — | — | — |
| F | — | 0.018 | — | — | — | — | — | — | — |
| G | — | — | — | — | — | — | 0.0014 | — | — |
| H | 0.012 | — | — | — | — | — | — | — | — |
| I | — | — | — | — | — | — | 0.0021 | 0.0016 | — |
| J | — | — | — | — | — | — | 0.0014 | — | 0.03Ce |
| K | 0.021 | — | — | — | — | — | 0.0015 | — | 0.04La |
| L | | — | — | — | — | — | — | — | — |
| M | 0.25 | 0.13 | — | — | — | — | 0.0016 | 0.0012 | — |
| N | — | — | — | — | — | — | 0.0018 | — | — |
| O | — | — | — | — | — | — | 0.0014 | — | — |
| P | — | — | — | 0.031 | — | — | — | — | — |
| Q | — | — | — | — | — | — | — | — | 0.06Nd |
| R | — | — | — | — | — | — | — | — | — |
| S | — | — | — | — | — | 0.0013 | — | — | 0.02Y |
| T | — | — | — | — | — | — | — | — | — |
| U | 0.008 | — | — | — | — | 0.0010 | 0.0014 | — | — |
| V | — | — | — | — | — | — | 0.0018 | — | — |
| W | — | — | — | — | — | — | 0.0019 | — | — |
| X | — | — | — | — | — | — | — | — | — |
| Y | — | — | — | — | — | — | 0.0015 | — | — |
| Z | — | — | — | — | — | — | — | — | — |

*means out of present invention method.
—means the content is a level of impurities.

TABLE 2

| | | | Forced-Cooling Condition | | | | | Evaluation | | | |
|---|---|---|---|---|---|---|---|---|---|---|---|
| | | | | | Isothermal Holding | | | | | Pipe | |
| Test No. | Steel | Heating Temperature (° C.) | 700~500° C. Average Cooling Rate (° C./min) | Finishing Temp. $T_A$ (° C.) | Temp. (° C.) | Time (min) | $T_A$~250° C. Cooling Rate#1 (° C./min) | Tensile Strength (MPa) | Uniform Elongation (%) | Expanding Performance | Others |
| 1 | A | 750 | 1400 | 310 | 390 | 60 | — | 1056 | 22.0 | ○ | Example of the present invention |
| 2 | B | 750 | 1400 | 330 | 400 | 60 | — | 766 | 25.7 | ○ | Example of the present invention |
| 3 | C | 740 | 1600 | 420 | Not conducted | | 5 | 922 | 24.1 | ○ | Example of the present invention |
| 4 | D | 740 | 1400 | 340 | 380 | 60 | — | 862 | 24.6 | ○ | Example of the present invention |
| 5 | E | 760 | 1400 | Room Temp. | Not conducted | | — | 774 | 25.7 | ○ | Example of the present invention |
| 6 | F | 740 | 1300 | 420 | Not conducted | | 4 | 1048 | 22.7 | ○ | Example of the present invention |
| 7 | G | 750 | 1700 | 310 | 400 | 60 | — | 1061 | 22.2 | ○ | Example of the present invention |
| 8 | H | 740 | 1700 | 300 | 380 | 60 | — | 855 | 24.5 | ○ | Example of the present invention |
| 9 | I | 760 | 1600 | Room Temp. | Not conducted | | — | 730 | 26.1 | ○ | Example of the present invention |
| 10 | J | 750 | 1400 | 420 | Not conducted | | 6 | 835 | 24.5 | ○ | Example of the present invention |
| 11 | K | 750 | 1700 | Room Temp. | Not conducted | | — | 1050 | 22.3 | ○ | Example of the present invention |
| 12 | L | 750 | 1300 | 420 | Not conducted | | 5 | 893 | 24.1 | ○ | Example of the present invention |
| 13 | M | 760 | 1300 | 400 | Not conducted | | 7 | 735 | 25.3 | ○ | Example of the present invention |
| 14 | N | 750 | 1400 | 310 | 410 | 30 | — | 947 | 23.4 | ○ | Example of the present invention |
| 15 | O | 740 | 1200 | 370 | 400 | 60 | — | 744 | 26.1 | ○ | Example of the present invention |
| 16 | P | 750 | 1600 | 320 | 420 | 30 | — | 919 | 24.2 | ○ | Example of the present invention |
| 17 | Q | 750 | 1500 | Room Temp. | Not conducted | | — | 1050 | 22.2 | ○ | Example of the present invention |
| 18 | R | 750 | 1500 | Room Temp. | Not conducted | | — | 741 | 25.9 | ○ | Example of the present invention |
| 19 | S | 750 | 1200 | 310 | 400 | | — | 995 | 22.8 | ○ | Example of the present invention |

TABLE 2-continued

| Test No. | Steel | Heating Temperature (° C.) | Forced-Cooling Condition: 700~500° C. Average Cooling Rate (° C./min) | Finishing Temp. $T_A$ (° C.) | Isothermal Holding Temp. (° C.) | Isothermal Holding Time (min) | $T_A$~250° C. Cooling Rate#1 (° C./min) | Evaluation: Tensile Strength (MPa) | Uniform Elongation (%) | Pipe Expanding Performance | Others |
|---|---|---|---|---|---|---|---|---|---|---|---|
| 20 | T | 740 | 1400 | Room Temp. | Not conducted | | — | 843 | 24.6 | ○ | Example of the present invention |
| 21 | U | 750 | 1400 | Room Temp. | Not conducted | | — | 1103 | 22.1 | ○ | Example of the present invention |
| 22 | C | 780 | 800 | Room Temp. | Not conducted | | — | 681 | 26.1 | ○ | Example of the present invention |
| 23 | H | 720 | 1600 | 350 | Not conducted | | 2 | 847 | 24.4 | ○ | Example of the present invention |
| 24 | J | 740 | 300 | 50 | Not conducted | | — | 657 | 25.8 | ○ | Example of the present invention |
| 25 | L | 760 | 180 | 80 | Not conducted | | — | 625 | 25.3 | ○ | Example of the present invention |
| 20 | V | 750 | 1300 | 330 | 380 | 30 | — | 958 | 22.8 | ○ | Example of the present invention |
| 27 | W* | 760 | 1700 | 430 | Not conducted | | 3 | 549 | 25.4 | ○ | Comparative example |
| 28 | X* | 750 | 1600 | 400 | 430 | 30 | — | 934 | 17.5 | x | Comparative example |
| 29 | Y* | 740 | 1400 | 370 | 400 | 60 | — | 869 | 18.5 | x | Comparative example |
| 30 | Z* | 750 | 1300 | 410 | Not conducted | | 4 | 993 | 18.8 | x | Comparative example |
| 31 | A | 1000* | 1500 | 340 | 420 | 30 | — | 1026 | 14.6 | x | Comparative example |
| 32 | C | 750 | 50* | 330 | 400 | 60 | — | 815 | 16.9 | x | Comparative example |
| 33 | F | 750 | 1500 | 600* | 260 | 60 | — | 965 | 16.6 | x | Comparative example |
| 34 | H | 750 | 1800 | 420 | Not conducted | | 35* | 888 | 15.9 | x | Comparative example |
| 36 | J | 750 | 1200 | 310 | 500* | 60 | — | 853 | 17.4 | x | Comparative example |
| 36 | L | 750 | 1600 | 420 | 410 | 1* | — | 851 | 17.2 | x | Comparative example |
| 37 | N | Quenched from 980° C. and tempered at 600° C. for 30 min* | | | | | | 945 | 12.9 | x | Conventional example |

*Out of present invention method.

#1Case without isothermal holding, after finishing forced cooling in the temperature region from 260° C. to 450° C.

Test numbers from 1 to 26 are of the present invention methods, and test numbers from 27 to 36 are of the comparison methods. In the numbers 27 to 30 of comparison methods, chemical compositions of the steel are out of the present invention. In the numbers 31 to 36 of comparison methods, the production processes are from the present invention, although their chemical compositions satisfy the present invention. In test number 37, the conventional quench and tempering was conducted to steel, satisfying the chemical composition in the present invention.

Results of present invention examples, comparison methods and a conventional method, shown in Table 2, are illustrated in FIG. 1.

As shown in Table 2 and FIG. 1, the specimens of present invention methods showed large tensile strength, TS (MPa), of 600 MPa or more. In the examples of present invention, uniform elongations, u-el (%), satisfied the following formula (1), and also satisfied formula (2), which is a favorable relationship, showing superior uniform elongation.

$$\text{u-el} \geq 28 - 0.0075\text{TS} \quad (1)$$

$$\text{u-el} \geq 29.5 - 0.0075\text{TS} \quad (2)$$

Whereas, in the comparison methods and a conventional method (test number 27), tensile strength was too low even when uniform elongation was acceptable, or uniform elongation was too low even when tensile strength was acceptable, showing poor performance applied to an oil well steel pipe.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

According to the present invention, a steel pipe with excellent expandability can be produced with good cost performance, in comparison with conventional methods. Therefore, the steel pipe of the present invention, since the pipe can be expanded with a high expanding ratio, without any perforated portion due to local thinning or large bending of the pipe, it becomes possible to develop an oil well or a gas well with good cost performance, leading to the contribution for a stable supply of energy in the world.

The invention claimed is:

1. A method for producing a steel pipe with excellent expandability, comprising steps of:

(a) heating the steel pipe having a diameter and wall thickness and a steel composition comprising, by mass %, C: 0.1 to 0.45%, Si: 0.3 to 3.5%, Mn: 0.5 to 5%, P: less than or equal to 0.03%, S: less than or equal to 0.01%, soluble Al: 0.01 to 0.8%, with a proviso that in a case where Si is not less than 0.30% and less than 1.5%, soluble Al is equal to 0.1% or more and not more than 0.8%, N: less than or equal to 0.05%, O: less than or equal to 0.01%, and optionally at least one element selected from at least one of Groups (A) to (E) specified below, and balance being Fe and impurities, wherein Group (A) of elements is; Cr: less than or equal to 1.5% and Cu: less than or equal to 3.0%;

wherein Group (B) of elements is; Mo: less than or equal to 1%;

wherein Group (C) of elements is; Ni: less than or equal to 2%;

wherein Group (D) of elements is; Ti: less than or equal to 0.3%, Nb: less than or equal to 0.3%, V: less than or equal to 0.3%, Zr: less than or equal to 0.3%, and B: less than or equal to 0.01%;

wherein Group (E) of elements is: Ca: less than or equal to 0.01%, Mg: less than or equal to 0.01%, and REM: less than or equal to 1.0%, to a temperature from 700 to 790° C., (b) forced-cooling the steel pipe having said diameter and wall thickness down to a temperature from 250 to 450° C., wherein the steel pipe is forced-cooled with a cooling rate greater than or equal to 100° C./min at a temperature ranging from 700 to 500° C., (c) soaking the steel pipe forced cooled to the temperature from 250 to 450° C. at a temperature from 250 to 450° C. for 10 min. or more, and then (d) cooling the soaked steel pipe down to room temperature.

* * * * *